US006234809B1

(12) United States Patent
Futatsugi

(10) Patent No.: US 6,234,809 B1
(45) Date of Patent: May 22, 2001

(54) CARD CONNECTOR

(75) Inventor: Takashi Futatsugi, Tokyo (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/363,322

(22) Filed: Jul. 28, 1999

(30) Foreign Application Priority Data

Jul. 30, 1998 (JP) ..... 10-216121

(51) Int. Cl.[7] ..... H01R 12/00
(52) U.S. Cl. ..... 439/64
(58) Field of Search ..... 439/64, 541.5, 439/79, 80

(56) References Cited

U.S. PATENT DOCUMENTS 5,286,207 * 2/1994 McHugh ..... 439/79
5,636,999 * 6/1997 Hirai et al. ..... 439/79
5,688,130 * 11/1997 Huang ..... 439/79
5,709,568 1/1998 Pan et al. ..... 439/541.5

* cited by examiner

*Primary Examiner*—Tulsidas Patel

(57) ABSTRACT

The present invention provides a card connector assembly for connecting cards such as PC cards including memory cards to circuit boards, which makes it possible to obtain highly reliable electrical connections, and which has a low height. The card connector assembly (1) is equipped with a card connector (10), pin contacts (30) of which have card contact sections (33, 34) that electrically connect with the card, and substantially horizontal sections (35, 36) that protrude from a first housing (20) substantially parallel to a circuit board (80), and a mating connector (50) electrical contacts (70) of which have termination portions (72) that are electrically connected to the circuit board (80), and contact portions (74) which are exposed at an upper surface of a second housing (60) and which electrically engage the pin contacts (30). Furthermore, the substantially horizontal sections (35, 36) of the pin contacts (30) are pressed against the contact portions (74) of the contacts (70) from the area above the mating connector (50), so that these substantially horizontal sections (35, 36) are caused to electrically engage the contact portions (74).

24 Claims, 7 Drawing Sheets

210
212
211
211a
200
230
231
221a
220
222
221
240

CARD CONNECTOR

FIELD OF THE INVENTION

The present invention relates to a card connector assembly that is used to electrically connect cards such as PC cards including memory cards, to circuit boards.

BACKGROUND OF THE INVENTION

Conventional card connector assembly 200 shown in FIG. 8 and disclosed in U.S. Pat. No, 5,709,568 comprises a card connector 210, which has a plurality of electrical contacts 212 for electrical connection to a PC card (not shown), a card edge connector 220, which is surface mount connected to conductive pads on a circuit board 240, and a connecting board 230 which is solder connected to the contacts 212 of the card connector 210 and insertion-connected to the card edge connector 210.

The card connector 210 has stacked insulating housings 211 so that two PC cards can be accommodated therein. Electrical contacts 212 are fastened by press-fitting to the connector sections 211*a* of the housings 211. The housings 211 are mounted on circuit board 240.

The card edge connector 220 is equipped with an insulating housing 221 which has a board-accommodating recess 221*a* that extends in the direction of length, and which is mounted on the circuit board 240, and a plurality of electrical contacts 222 which are mounted in the housing 221 in a row and which electrically engage conductive pads 231 on the connecting board 230. The contacts 222 are electrically connected to the conductive pads on the circuit board 240.

The connecting board 230 is solder-connected to the plurality of contacts 212 protruding from the connector sections 211*a* of the card connector 210 horizontally with respect to the wall surfaces of the connector sections 211*a*, i.e., perpendicularly with respect to the circuit board 240. Afterward, the connecting board 230 is accommodated in the board-accommodating recess 221*a* of the card edge connector 220 so that the conductive pads 231 and contacts 222 electrically engage each other. As a result, the PC cards are electrically connected to the circuit board 240 via the contacts 212 of the card connector 210, the connecting board 230, and the contacts 222 of the card edge connector 220.

However, in the case of such a conventional card connector assembly 200, a separate connecting board 230 is necessary in order to connect the card connector 210 and card edge connector 220 to each other. As a result, the number of parts required is large, and the number of contacts is large, so that the reliability of the electrical connections decreases.

Furthermore, since the connecting board 230 is installed perpendicular to the circuit board 240, the overall height of the card connector assembly 200 is increased.

Accordingly, an important object of the present invention is to provide a card connector assembly for connecting cards such as PC cards including memory cards to circuit boards, which makes it possible to obtain highly-reliable electrical connections, and which has a low height.

SUMMARY OF THE INVENTION

The card connector assembly of the present invention is equipped with a card connector having an insulating first housing mounted on a circuit board, and electrical pin contacts mounted in the first housing with each of the pin contacts having a card contact section that electrically engages electrical contacts in the card and a substantially horizontal section that protrudes from the first housing substantially parallel to the circuit board, and a mating electrical connector having an insulating second housing mounted on the circuit board, and electrical contacts mounted in the second housing, with each of the electrical contacts having a connecting section that is electrically connected to the circuit board and a contact section that is exposed at an upper surface of the second housing and that electrically engages one of the pin contacts, and the substantially horizontal sections of the pin contacts electrically engage the contact sections of the contacts of the mating connector as a result of being pressed against the contact sections from above the mating connector.

Furthermore, it is effective if the contact sections of the electrical contacts of the mating connector are constructed as flexible spring members, and the substantially horizontal sections of the pin contacts are supported by a support housing so that upward movement of the substantially horizontal sections caused by the resilient force of the contact sections when the horizontal sections engage the exposed contact sections is checked.

Additionally, it is much more effective if the support housing is fastened to the circuit board together with the first housing.

Furthermore, the contact sections of the electrical contacts may be constructed as rigid members that are fastened to the second housing, and the substantially horizontal sections of the electrical contacts may be constructed as flexible spring members.

BRIEF DESCRIPTION OF THE DRAWINGS

FIG. 5A is a top plan view,

FIG. 5B is a front view,

FIG. 5C is a bottom view, and

FIG. 5D is a cross-sectional view taken along line 5D—5D in FIG. 5A.

FIG. 6A is a top plan view, and

FIG. 6B is a cross-sectional view taken along line 6B—6B in FIG. 6A.

DETAILED DESCRIPTION OF THE INVENTION

Figure 1:
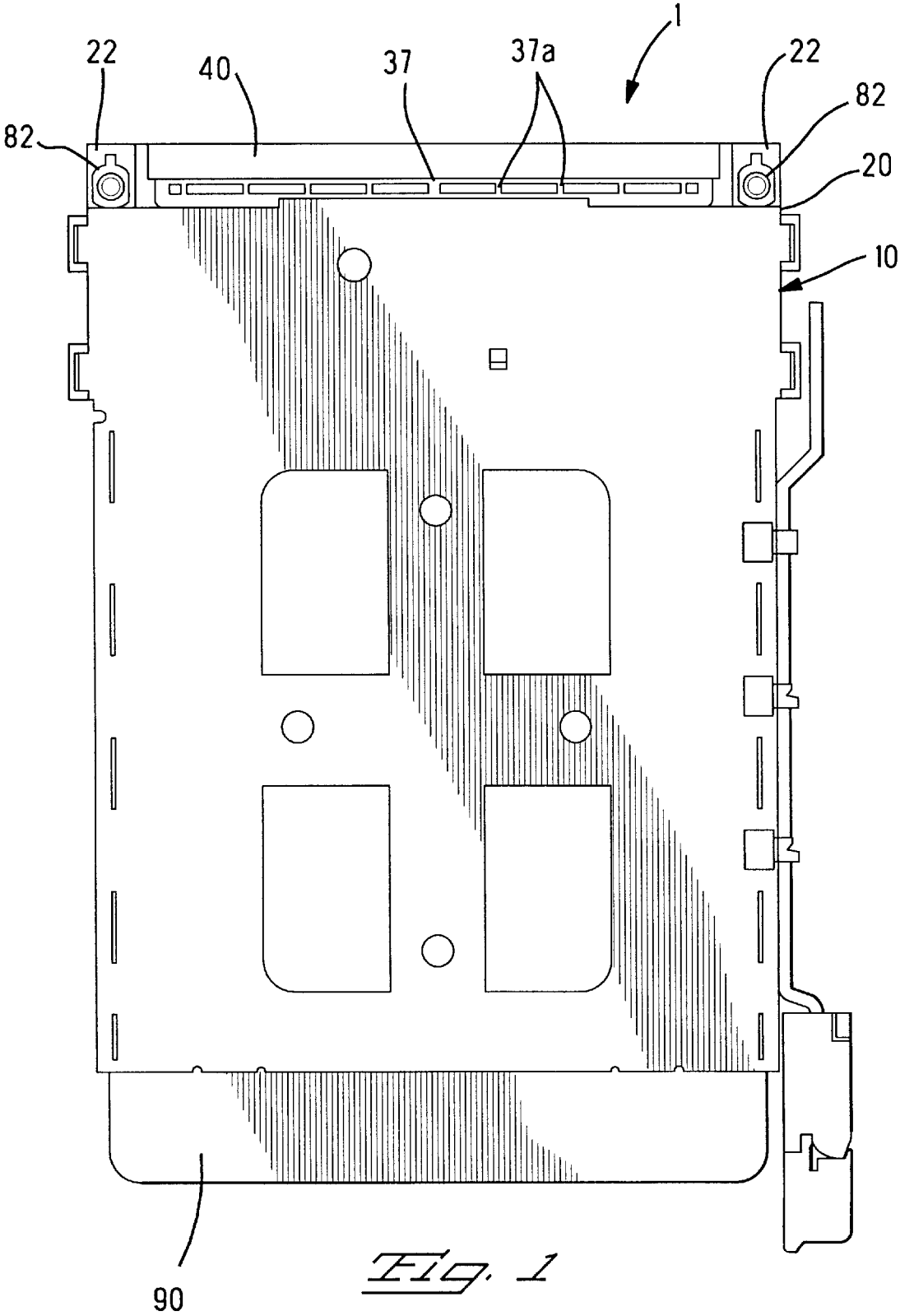
FIG. 1 is a top plan view of a card connector assembly of the present invention.
Figure 2:
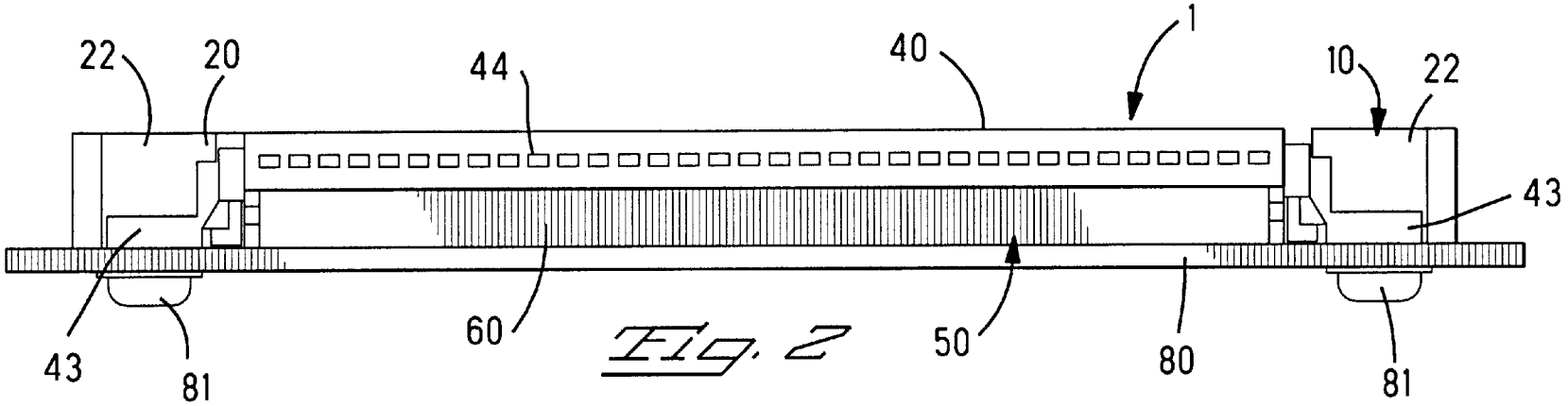
FIG. 2 is a front view of the card connector assembly shown in FIG. 1.
Figure 3:
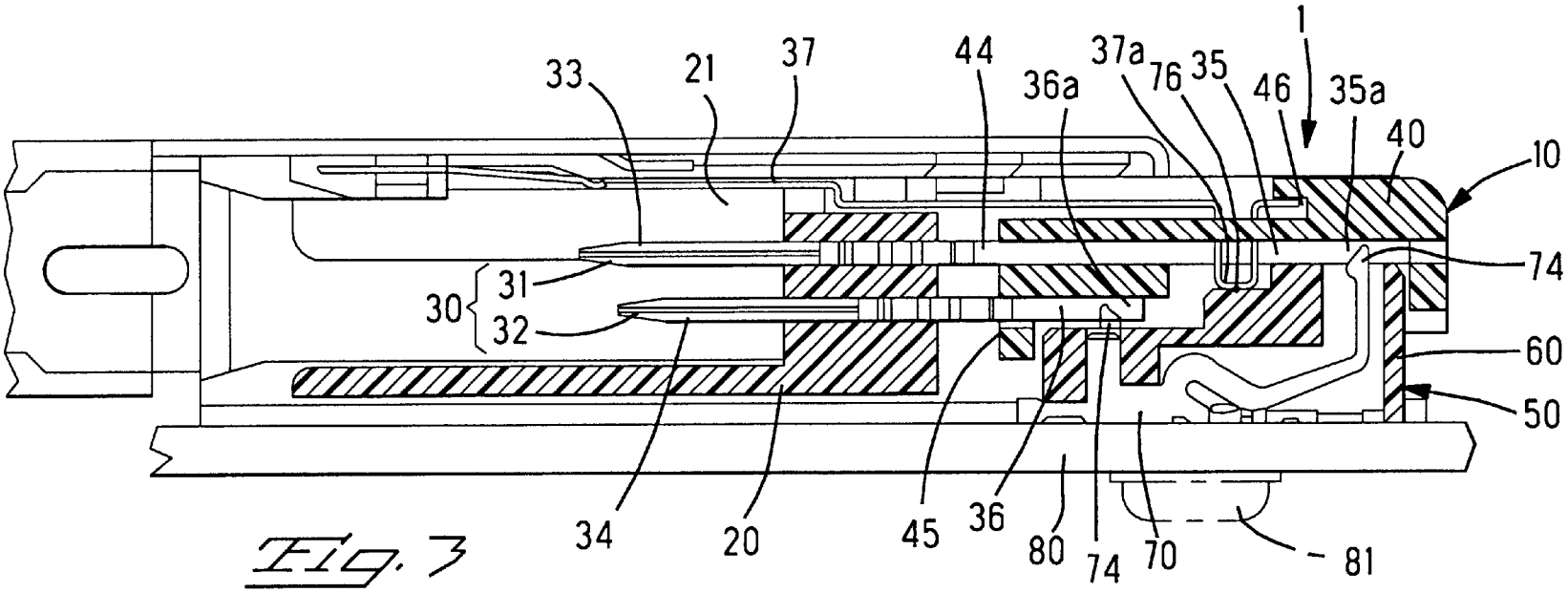
FIG. 3 is a cross-sectional view of essential parts of the card connector assembly shown in FIG. 1.

In FIGS. 1–3, card connector assembly 1 is equipped with a card connector 10, which accommodates cards such as PC cards 90 including memory cards and which is mounted on a circuit board 80, and a mating electrical connector 50, which is mounted on the circuit board 80 and which is connected with the card connector 10 when the card connector 10 is mounted on the circuit board 80. When the card connector 10 is connected to the mating connector 50, the card connector 10 is electrically connected to the circuit board 80 via the mating connector 50; accordingly, when a PC card 90 is inserted into the card connector 10, PC card 90 is electrically connected to the card connector 10 and it is electrically connected to the circuit board 80 via the mating connector 50.

Here, the card connector 10 comprises an insulating first housing 20, which has a card-accommodating recess 21 that accommodates PC card 90 and which is mounted on the circuit board 80, a plurality of electrical card or pin contacts 30, which are attached in upper and lower rows along a lateral left-right direction relative to FIG. 1 of the first housing 20, and a support housing 40, which supports substantially horizontal sections 35, 36 of the pin contacts 30.

The first housing 20 is molded from a suitable insulating resin material; a pair of housing-mounting sections 22 are located on both ends of a front side (the upper side in FIG. 1) of the first housing 20 so that the housing-mounting sections 22 protrude therefrom. The housing-mounting sections 22 serve to attach the first housing 20 to the circuit board 80 by means of screws 81 and nuts 82 along with support-mounting sections 43 of the support housing 40. In this way, the first housing 20 is mounted on the circuit board 80. For this purpose, nuts 82 are provided in the housing-mounting sections 22.

Figure 4:
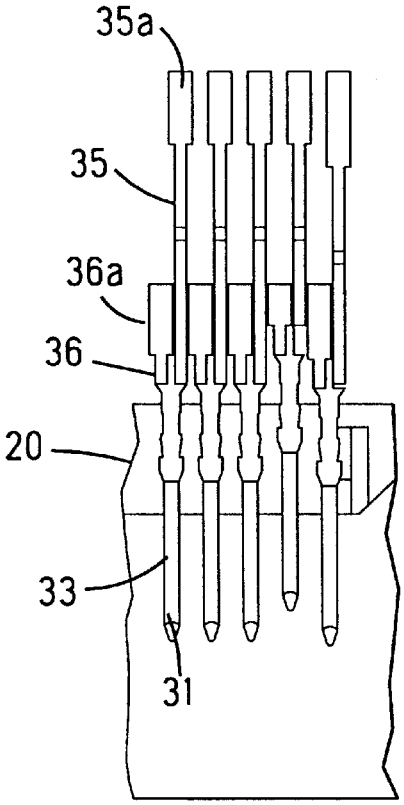
FIG. 4 is a part plan view showing the attachment of the pin contacts to the first housing of the card connector which forms a part of the card connector assembly shown in FIG. 1.

The upper-row contacts 31 and lower-row contacts 32 of the pin contacts 30 are respectively formed by stamping and forming metal plates. The pin contacts have card contact posts 33, 34, which electrically engage the electrical contact members (not shown) of the PC card 90, and substantially horizontal sections 35, 36, which protrude from the first housing 20 substantially parallel to the circuit board 80; furthermore, the pin contacts are fastened in through-holes of the first housing 20 by press-fitting therein. As shown in FIG. 4, the substantially horizontal sections 35, 36 of the upper-row contacts 31 and lower-row contacts 32 are shifted by a half-pitch relative to each other in the lateral direction, and they have wide contact-engaging sections 35*a*, 36*a* at their respective ends. The contact-engaging sections 35*a* of the upper-row contacts 31 are arranged at a specified pitch in a single row so that the amount of protrusion thereof from the first housing 20 is greater than that of the contact-engaging sections 36*a* of the lower-row contacts 32; furthermore, the contact-engaging sections 36*a* of the lower-row contacts 32 are arranged at a specified pitch in a single row so that the amount of protrusion thereof is less than that of the contact-engaging sections 35*a* of the upper-row contacts 31. Moreover, a ground plate 37, which electrically engages ground contacts (not shown) of the PC card 90 is located on an upper portion of the first housing 20 so that the ground plate 37 covers the upper portions of the pin contacts 30. The ground plate 37 has a plurality of substantially U-shaped bent portions 37*a* which are bent downward at the front of the ground plate 37; they are arranged at a specified pitch in the lateral direction and serve as ground contacts.

The support housing 40 is molded from a suitable insulating resin. As shown in FIGS. 1–3 and FIG. 5, support housing 40 is equipped with a base section 41 formed substantially in the shape of a rectangular parallelepiped, which extends in the lateral direction and which has a mating connector-accommodating recess 42 (for the accommodation of the mating connector 50) formed in step form in its undersurface, and a pair of support-mounting sections 43 located at both ends of the base section 41 in the lateral direction so that these support-mounting sections 43 protrude therefrom. A plurality of pin contact through-holes 44, 45 are located in the base section 41 in upper and lower rows extending in the lateral direction so that the pin contact through-holes 44, 45 correspond to the substantially horizontal sections 35, 36 of the pin contacts 30. The pin contact through-holes 44 through which the substantially horizontal sections 35 of the upper-row contacts 31 pass, and the pin contact through-holes 45 through which the substantially horizontal sections 36 of the lower-row contacts 32 pass, extend through from the front surface (i.e., the left surface in FIG. 5D) of the base section 41 toward the mating connector recess 42 that is formed in a step configuration. Furthermore, a supporting recess 46, which accommodates an end portion of the ground plate 37 of the card connector 10 and which supports the ground plate 37, is located in a projection 41*a* on an upper surface of the base section 41, and a plurality of ground plate through-holes in the form of slots 41*b*, through which the bent portions 37*a* of the ground plate 37 are passed, are located in the upper surface of the base section 41 at a specified pitch in the lateral direction. Furthermore, screw holes 43*a*, through which the attachment screws 81 are passed, are located in the support-mounting sections 43.

After a plurality of pin contacts 30 have been secured by press-fitting to the first housing 20 of the card connector 10, the support housing 40 is mounted to the first housing 20 by passing the substantially horizontal sections 35, 36 of the pin contacts 30 through the pin contact through-holes 44, 45, passing the bent portions 37*a* of the ground plate 37 through the ground plate through-holes 41*b*, and inserting an end of the ground plate 37 into the supporting recess 46. As a result, the card connector 10 is completed. In this case, the undersurfaces of the contact-engaging sections 35*a*, 36*a* of the substantially horizontal sections 35, 36 of the pin contacts 30 are exposed facing downward.

Figure 6A:
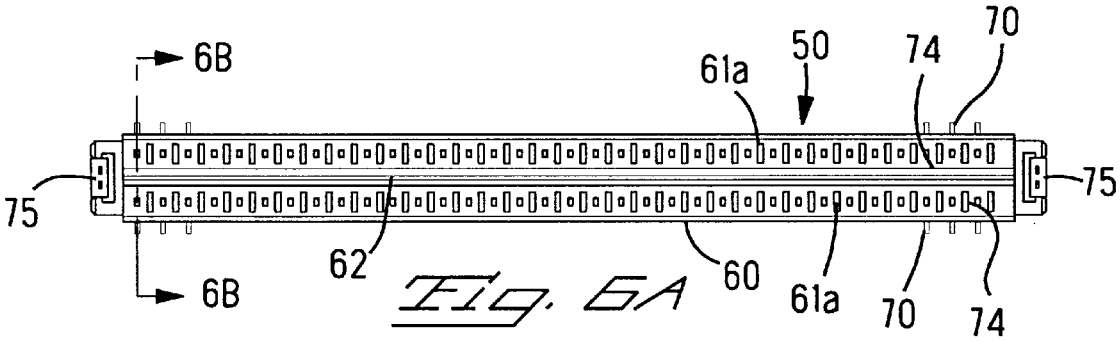
FIGS. 6A and 6B show the mating connector which forms a part of the card connector assembly shown in FIG. 1.
Figure 6B:
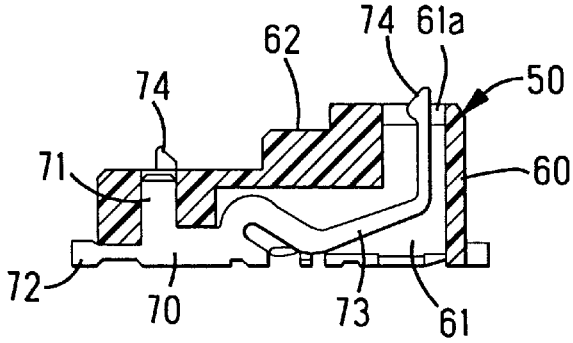
Figure 5A:
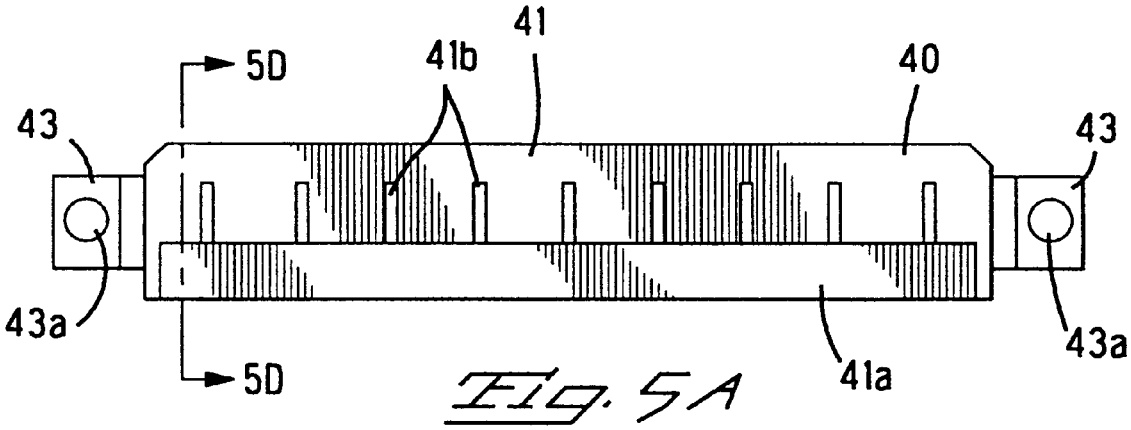
FIGS. 5A–5D show a support housing used in the card connector.
Figure 5B:
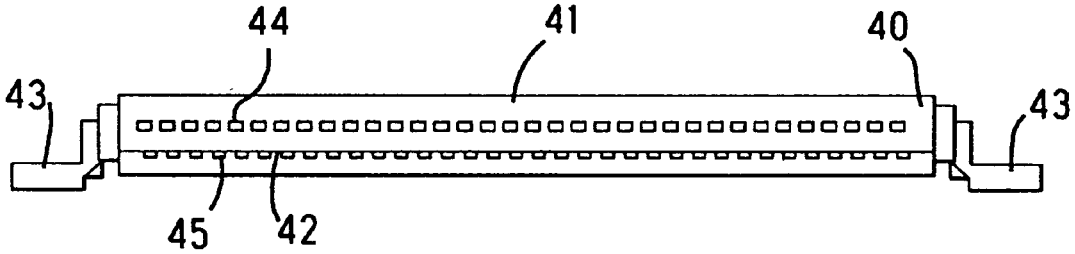
Figure 5C:
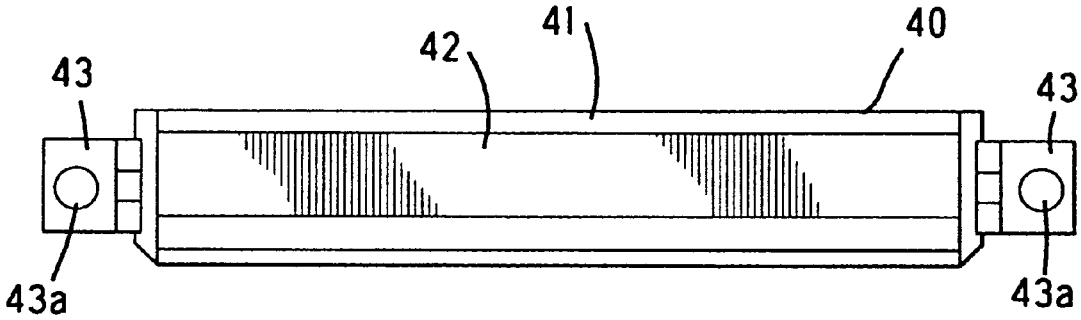
Figure 5D:
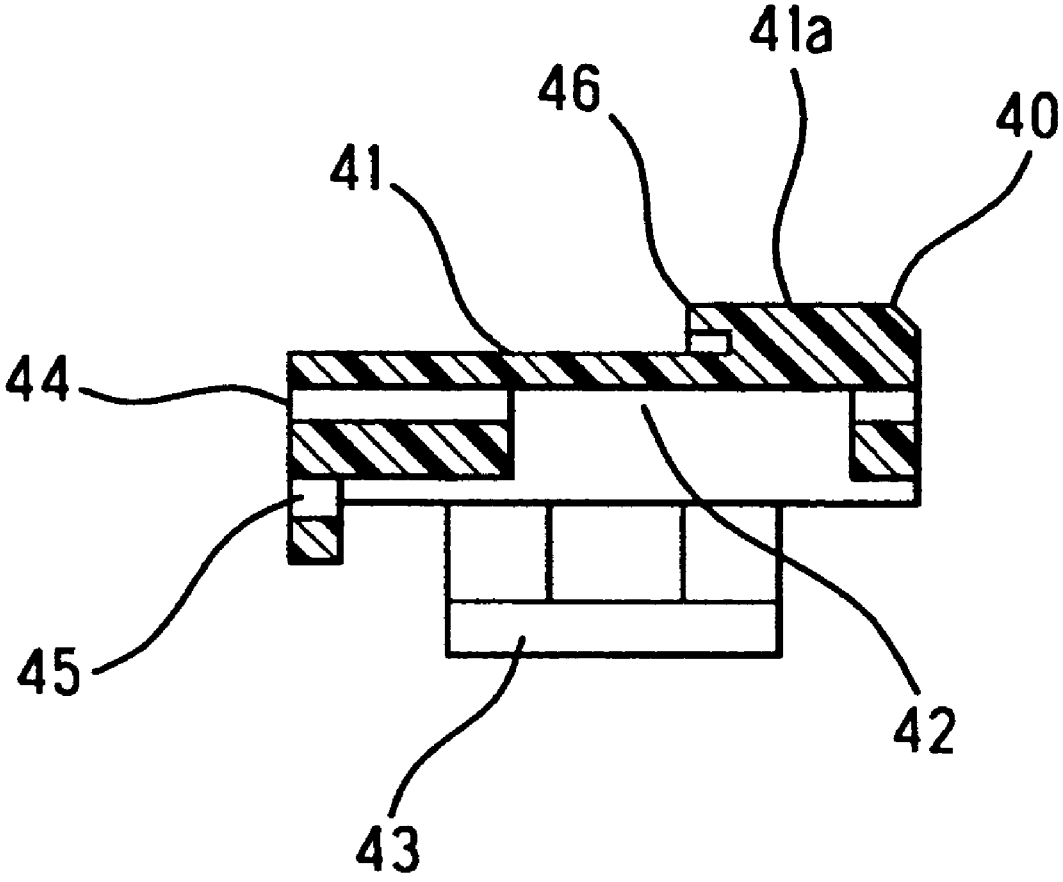

Next, as shown in FIGS. 6A and 6B, the mating electrical connector 50, which is electrically connected to the card connector 10, has a second housing 60, which is mounted on the circuit board 80, a plurality of electrical contacts 70, which are secured to the second housing 60 in a single row in a lateral direction, and a pair of solder members 75, which are disposed on both ends of the second housing 60 in the lateral direction and which are solder-connected to a surface of the circuit board 80. The electrical contacts 70 are arranged so that they electrically engage the contact-engaging sections 35*a*, 36*a* of the substantially horizontal sections 35, 36 of the pin contacts 30 of the card connector 10. Accordingly, the pin contacts 30 are arranged in the lateral direction of the second housing 60 at a pitch equal to the pitch between the contact-engaging sections 35*a*, 35*b*.

The second housing 60 is molded from a suitable insulating resin material; furthermore, as shown in FIG. 6, a plurality of contact-accommodating recesses 61, which accommodate the contacts 70 therein, are located in a single row in the lateral direction, and an upper surface has a stepped configuration. Openings 61*a* are located in upper walls of lower and higher stepped sections of the second housing 60 through which contact portions 74 of the contacts 70 protrude and they are in communication with the respective contact-accommodating recesses 61 so that the contact portions 74 of the contacts 70 are exposed at the upper surfaces of the second housing 60. The openings 61*a* are alternately positioned on opposite sides along the lateral direction in correspondence with the contact portions 74 of the contacts 70.

Each of the contacts 70 has a contact-securing portion 71 which is press-fitted in a tapered slot 60*a* in the second housing 60 in alignment with the respective contact-accommodating recess 61, a termination portion 72, which extends to both sides of the contact-securing portion 71 and which is electrically connected by soldering to a conductive pad (not shown) on the circuit board 80, a spring portion 73, which possesses resiliency and which extends along the corresponding contact-accommodating recess 61 from the termination portion 72, and contact portion 74, which passes through the opening 61*a* in the housing 60 from the spring portion 73 and protrudes from the respective upper surface of the housing 60. The contact portions 74 are alternately positioned on opposite sides of the second housing 60 along the lateral direction, and resiliently and electrically engage the contact-engaging sections 35*a*, 35*b* of the pin contacts 30 of the card connector 10 when the card connector 10 is mounted on the circuit board 80. Furthermore, a drain wire recess 62 is located in the upper surface of the intermediate step section of the second housing 60 along the lateral direction thereof, and a metal drain wire 76 (FIG. 3), both ends of which are electrically connected to the solder members 75, is disposed within the drain wire recess 62.

In order to connect the card connector 10 to the mating connector 50 mounted on the circuit board 80, the contact-engaging sections 35*a*, 36*a* of the pin contacts 30 of the card connector 10 are pressed against the contact portions 74 of the contacts 70 from the area above the mating connector 50, and the attachment screws 81 are screwed into the nuts 82 via the support-mounting sections 43 of the support housing 40 and the housing-mounting sections 22 of the first housing 20 from the area beneath the circuit board 80. As a result, the card connector 10 is electrically connected to the mating connector 50, and the card connector 10 is also mounted on the circuit board 80. In this case, the bent portions 37*a* of the ground plate 37 of the card connector 10 electrically engage the drain wire 76 of the mating connector 50, so that the ground plate 37 is grounded to the circuit board 80 via the drain wire 76 and solder members 75. Furthermore, the spring portions 73 of the contacts 70 of the mating connector 50 flex resiliently downward when the contact-engaging sections 35*a*, 36*a* of the pin contacts 30 engage the contact portions 74. Since the substantially horizontal sections 35, 36 of the pin contacts 30 engage the contact portions 74 of the contacts 70 as a result of being pressed against the contact portions 74 from the area above the mating connector 50, a connecting board to establish mutual connection between the connectors is therefore needed; accordingly, the number of electrical connections is reduced, so that the reliability of the electrical connections is high. Furthermore, the overall height of the card connector assembly 1 can be reduced. Since the contact portions 74 of the contacts 70 are part of flexible springs, electrical connection between the pin contacts 30 and contacts 70 can be reliably established. Furthermore, since the substantially horizontal sections 35, 36 of the pin contacts 30 are supported by the support housing 40 so that the upward movement of the substantially horizontal sections 35, 36 caused by the resilient force of the contact sections 74 is restricted, the substantially horizontal sections 35, 36 of the pin contacts 30 are not deformed by the resilient force of the contact portions 74. In addition, since the support housing 40 is fastened to the circuit board 80 along with the first housing 20 of the card connector 10, the support housing is not caused to float upward by the resilient force of the contacts 70 when the card connector 10 is connected to the mating connector 50 and mounted on the circuit board 80.

Figure 7:
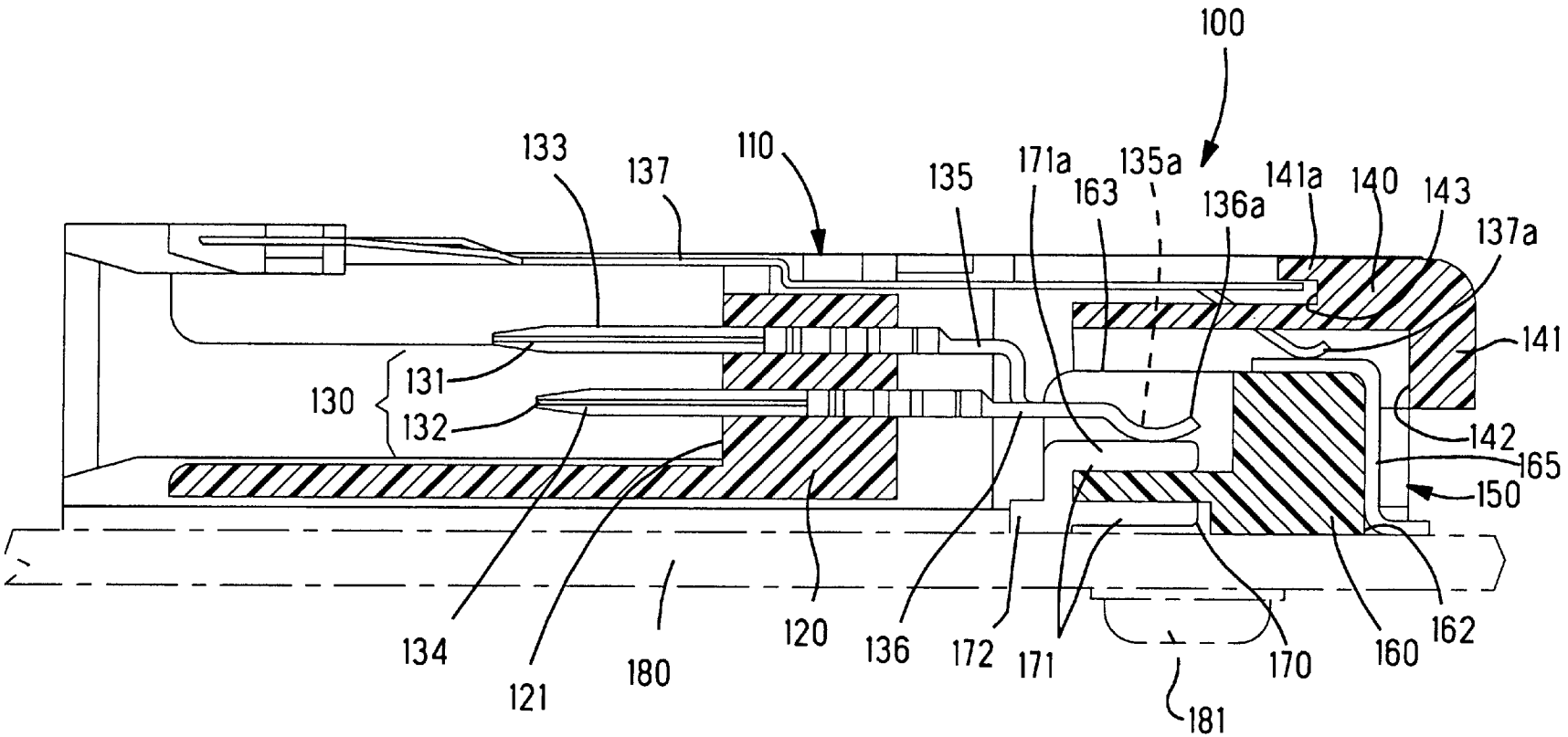
FIG. 7 is a cross-sectional view of an alternative embodiment of the card connector assembly of the present invention.
Figure 8:
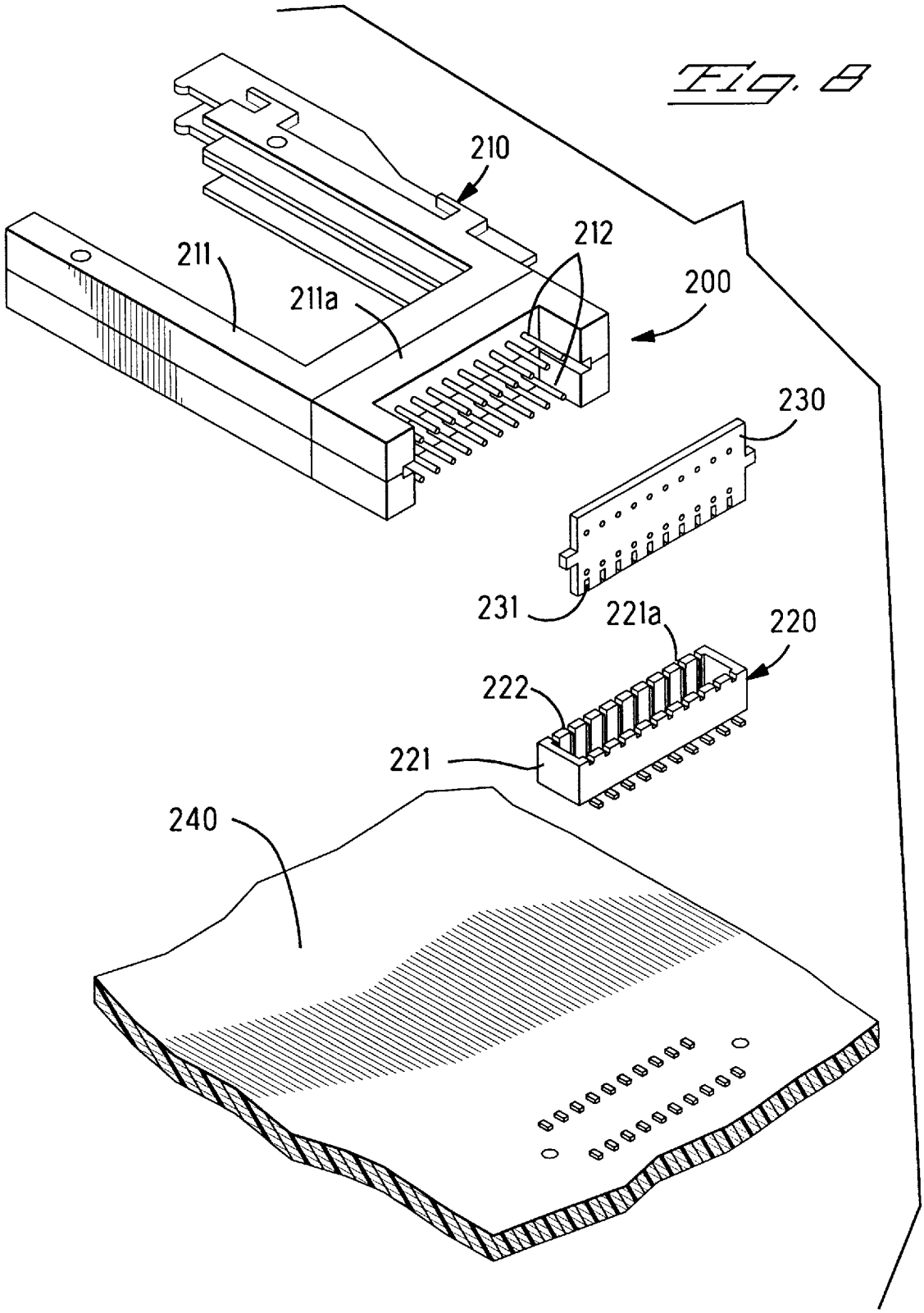
FIG. 8 is an exploded perspective view of a conventional card connector assembly.

Next, an alternative embodiment of the card connector assembly of the present invention will be described with reference to FIG. 7 The basic structure of card connector assembly 100 shown in FIG. 7 is similar to that of the card connector assembly 1 shown in FIGS. 1–6; however, the two card connector assemblies differ greatly in the following respects: specifically, contact portions 171*a* of electrical contacts 170 of mating connector 150 are rigid members, which are fastened to second housing 160, and substantially horizontal sections 135, 136 of pin contacts 130 of the card connector 110 are resilient spring members. Furthermore, support housing 140 supports only an end portion of ground plate 137 disposed along an upper surface of first housing 120 of the card connector 110; the substantially horizontal sections 135, 136 of the pin contacts 130 are not supported.

In FIG. 7, the card connector assembly 100, like the card connector assembly 1 shown in FIGS. 1–6, is equipped with a card connector 110, which accommodates cards such as PC cards including memory cards and which is mounted on a circuit board 180, and a mating connector 150, which is mounted on the circuit board 180 and which is electrically connected with the card connector 110 when the card connector 110 is mounted on the circuit board.

The card connector 110 has an insulating first housing 120 which has a card-accommodating recess 121 that accommodates a PC card, and which is mounted on the circuit board 180, a plurality of electrical pin contacts 130 are secured in upper and lower rows along a lateral direction of the first housing 120, and a support housing 140 supports the end portion of ground plate 137 disposed along the upper surface of the first housing 120 of the card connector 110.

As in the card connector 10 shown in FIGS. 1–6, a pair of housing-mounting sections (not shown) are located at both ends on a front side of the first housing 120 so that the mounting sections protrude therefrom. Like the housing-mounting sections 22 shown in FIGS. 1–6, the housing-mounting sections are secured to the circuit board 180 by means of attachment screws 181 and nuts (not shown) along with support-mounting sections (not shown) of the support housing 140; in this way, the first housing 120 is mounted on the circuit board 180.

As in the case of the pin contacts 30 shown in FIGS. 1–6, the respective upper-row contacts 131 and lower-row contacts 132 of the pin contacts 130 have card contact sections 133, 134, which electrically connect with the electrical contacts of the PC card, and substantially horizontal sections 135, 136, which protrude from the first housing 120 substantially parallel to the circuit board 180; furthermore, the contacts 131, 132 are secured to the first housing 120 by press-fitting in through-holes therein. Unlike the pin contacts 30 shown in FIGS. 1–6, the substantially horizontal sections 135, 136 are not supported by the support housing 140, as will be described later. Accordingly, they are resilient spring contact sections. The substantially horizontal sections 135 of the upper-row contacts 131 protrude from the housing 120 substantially parallel to the circuit board 180 for a certain distance, and they are then bent vertically downward, after which the substantially horizontal sections 135 again extend substantially parallel to the circuit board 180 and in the same plane as the substantially horizontal sections 136 of the lower-row contacts 132. Arcuate contact sections 135*a*, 136*a* are respectively located at the ends of the substantially horizontal sections 135 of the upper-row contacts 131 and the ends of the substantially horizontal sections 136 of the lower-row contacts 132. The pitch of the arcuate contact sections 135*a*, 136*a* is the same as the pitch of the contact-engaging sections 35*a*, 35*b* shown in FIG. 4. Furthermore, ground plate 137, which engages the ground contacts of the PC card, is disposed along an upper surface of the first housing 120 so that the ground plate 137 covers upper portions of the pin contacts 130. The ground plate 137 has a plurality of cantilever contact members 137*a*, which are bent downward at the front of the ground plate 137. The contact members 137*a* are arranged at a specified pitch in the lateral direction.

The support housing 140 is equipped with a base section 141 in the shape of a rectangular parallelepiped, which extends in the lateral direction and which has a mating connector-accommodating recess 142 for the accommodation of the mating connector 150 in its undersurface, and a pair of support-mounting sections (not shown) at both ends of the base section 141 in the lateral direction so that the support-mounting sections protrude therefrom. A supporting recess 143, which accommodates the end portion of the ground plate 137 of the card connector 110 and which supports the ground plate 137, is located in a step section 141*a* on the upper surface of the base section 141, and a plurality of ground plate through-holes (not shown), through which the resilient contact members 137*a* of the ground plate 137 extend, are located in an upper surface of the base section 141 at a specified pitch in the lateral direction.

After the contacts 130 have been secured by press-fitting to the first housing 120 of the card connector 110, the support housing 140 is mounted to the first housing 120 by inserting the end portion of the ground plate 137 into the supporting recess 143. As a result, the card connector 110 is completed. In this case, the undersurfaces of the arcuate contact sections 135*a*, 136*a* of the substantially horizontal sections 135, 136 of the pin contacts 130 remain exposed facing downward. The support housing 140 supports only the end portion of the ground plate 137 disposed along the upper surface of the first housing 120, and it does not support the substantially horizontal sections 135, 136 of the pin contacts 130; accordingly, the construction of the support housing 140 can be simplified compared to the support housing 40 shown in FIGS. 1–3; furthermore, the support housing 140 can be simply attached to the first housing 120.

Next, the mating connector 150, which is connected to the card connector 110, has a second housing 160, which is mounted on the circuit board 180, a plurality of electrical contacts 170, which are secured to the second housing 160 in a single row in the lateral direction, and a grounding plate 165, which is secured along a rear wall 162 and upper surface 163 of the second housing 160. The grounding plate 165 has a Z-shape in cross-section so that a bottom leg thereof is electrically connected to the circuit board 180. The contacts 170 are arranged so that they electrically engage the arcuate contact sections 135*a*, 136*a* of the substantially horizontal sections 135, 136 of the pin contacts 130 of the card connector 110. Accordingly, the pin contacts 130 are arranged in the lateral direction of the second housing 160 at a pitch equal to the pitch between the arcuate contact sections 135*a*, 135*b*.

Each of the contacts 170 has a contact-securing portion 171, which is substantially U-shaped in cross section and which is secured by press-fitting to a projection 161 of the second housing 160, and a termination portion 172, which extends to one side from the contact-securing portion 171 and which is fastened by soldering to a conductive pad (not shown) on the circuit board 180. An upper portion of the contact-securing portion 171 constitutes a contact portion 171*a* which electrically engages the corresponding circuit contact sections 135*a*, 136*a* of the substantially horizontal sections 135, 136 of the pin contacts 130 of the card connector 110. Contact portions 171*a* are exposed in the second housing 160. Since the contact portions 171*a* are rigid members, which are secured to the second housing 160, the construction of the contacts 170 can be simplified compared to that of the contacts 70 shown in FIGS. 1–3.

In order to connect the card connector 110 to the mating connector 150 mounted on the circuit board 180, the arcuate contact sections 135*a*, 136*a* are wipingly pressed against the upper surfaces of the contact portions 171*a* of the contacts 170 from the area above the mating connector 150, and the attachment screws 181 are screwed into the nuts via the support-mounting sections of the support housing 140 and the housing-mounting sections of the first housing 120 from the area beneath the circuit board 180. As a result, the card connector 110 is connected to the mating connector 150, and the card connector 110 is also mounted on the circuit board 180. In this case, the contact members 137*a* of the ground plate 137 of the card connector 110 electrically engage the grounding plate 165 of the mating connector 150, so that the ground plate 137 is grounded to the circuit board 180 via the bottom leg of the grounding plate 165. Furthermore, as a result of the substantially horizontal sections 135, 136 of the pin contacts 130 being pressed against the contact portions 171*a* of the contacts 170 from the area above the mating connector 150, the substantially horizontal sections 135, 136 are resiliently deformed upward as they electrically engage the contact portions 171*a*.

In the card connector assembly, the assembly is equipped with a card connector, the pin contacts of which have card contact sections that electrically connect the card, and substantially horizontal sections that protrude from a first housing substantially parallel to a circuit board, and a mating connector, the contacts of which have termination portions that are electrically connected to the circuit board, and contact portions which are exposed at an upper surface of a second housing and which electrically engage the pin contacts. Furthermore, the substantially horizontal sections of the pin contacts are pressed against the contact portions from the area above the mating connector, so that the substantially horizontal sections are caused to electrically engage the contact portions. As a result, there is no need for a connecting board to establish mutual connection between the connectors; accordingly, the number of electrical connections is reduced, so that the reliability of the electrical connections is high. Furthermore, the overall height of the card connector assembly is reduced.

In the card connector assembly, the contact portions of the contacts are spring portions, and the substantially horizontal sections of the pin contacts are supported by a support housing so that the upward movement of the substantially horizontal sections caused by the resilient force of the contact portions when the substantially horizontal sections engage the contact portions is restricted. Accordingly, electrical engagement between the pin contacts and the contacts of the mating connector can be reliably established; furthermore, there is no deformation of the substantially horizontal sections of the pin contacts by the resilient force of the contact portions of the contacts.

In the card connector assembly, the support housing is fastened to the circuit board along with the first housing of the card connector; accordingly, when the card connector is connected to the mating connector and mounted on the circuit board, the support housing is not caused to float upward by the resilient force of the contact portions of the contacts.

In the card connector assembly, the contact portions of the contacts are rigid members, which are secured to the second housing, and the substantially horizontal sections of the pin contacts are flexible spring members; accordingly, the construction of the contacts on the mating connector can be simplified.

What is claimed is:

1. A card connector assembly, comprising:

a card connector having a first insulating housing including a card-accommodating recess for mounting onto a circuit board;

electrical card contacts secured in the first insulating housing and having card contact sections extending into the card-accommodating recess and exposed contact-engaging sections;

a second insulating housing for mounting onto the circuit board and having contact-mounting means;

electrical contacts disposed along the contact-mounting means;

termination portions of the electrical contacts extend outwardly from the second insulating housing for electrical connection to conductive members on the circuit board;

contact portions of the electrical contacts electrically engage respective exposed contact-engaging sections;

a support housing mountable on the circuit board and including through-holes in which the exposed contact-engaging sections are mounted and disposed parallel to the circuit board.

2. A card connector as claimed in claim 1, wherein the second insulating housing has openings in an upper wall through which the contact portions extend.

3. A card connector as claimed in claim 1, wherein a spring portion extends between the contact portion and the termination portion.

4. A card connector as claimed in claim 1, wherein the support housing has slots extending therethrough, a ground plate is mounted along the first insulating housing and the support housing, bent portions of the ground plate extend through the respective slots.

5. A card connector as claimed in claim 4, wherein a drain wire extends along an upper surface of the second insulating housing for electrical connection with the bent portions of the grounding plate.

6. A card connector as claimed in claim 4, wherein a front end of the ground plate is disposed in a supporting recess in the support housing.

7. A card connector as claimed in claim 2, wherein the second insulating housing has a stepped configuration with an upper stepped surface and a lower stepped surface, the openings extend through the upper stepped surface and the lower stepped surface and are staggered along a lateral direction of the second insulating housing.

8. A card connector as claimed in claim 7, wherein an intermediate stepped surface is located between the upper stepped surface and the lower stepped surface, and a drain wire is disposed along the intermediate stepped surface.

9. A card connector as claimed in claim 8, wherein a ground plate extends along the first insulating housing and includes U-shaped ground contacts electrically connected with the drain wire.

10. A card connector as claimed in claim 1, wherein ends of the contact-engaging sections have arcuate contact sections.

11. A card connector as claimed in claim 10, wherein the contact-mounting means of the second insulating housing is a projection, the contact portions are U-shaped and are pressed-fitted onto the projection with an upper leg of the U-shaped contact portions being a contact portion electrically engaging a respective arcuate contact section.

12. A card connector as claimed in claim 11, wherein a Z-shaped grounding plate is mounted on the second insulating housing with an upper leg of the Z-shaped grounding plate extending along an upper surface of the second insulating housing, a middle leg of the Z-shaped grounding plate extending along an outer wall of the second insulating housing and a bottom leg of the Z-shaped grounding plate is to be electrically connected to the circuit board.

13. A card connector as claimed in claim 12, wherein a support housing is mountable on the circuit board and includes through-holes through which cantilever ground contacts of a ground plate extending along the first insulating housing and the support housing extend and are electrically connected to the upper leg of the Z-shaped grounding plate.

14. The card connector of claim 1 wherein the first housing further comprises a ground plate mounted along a card accommodating recess.

15. The card connector of claim 14 wherein the support housing has slots for receiving portions of the ground plate.

16. The card connector of claim 15 further comprising a drain wire disposed in the second insulating housing for electrical connection with the portions of the ground plate.

17. A card connector comprising:

a first insulating housing having first contacts, each first contact being engageable with a card and having an arcuate contact section;

a second insulating housing having U-shaped board mountable contacts each being press fit onto a respective projection formed on the second insulating housing, the board mountable contacts having contact portions formed on one leg of the U-shaped contacts for engaging respective arcuate contact sections; and, a support housing positioned adjacent the first insulating housing and having passageways, the first contacts entering the passageways to engage the contact portions of the board mountable contacts.

18. The card connector of claim 15 wherein the second insulating housing has openings in an upper wall through which the first contacts pass.

19. The card connector of claim 15 wherein the board mountable contacts further comprise a spring portion disposed adjacent a mounting portion.

20. The card connector of claim 16 wherein the second insulating housing further comprises upper and lower stepped surfaces forming the upper wall.

21. The card connector of claim 20 wherein the openings in the lower stepped surface are staggered with respect to the openings in the upper stepped surface.

22. The card connector of claim 21 further comprising an intermediate stepped surface between the upper and lower stepped surfaces.

23. The card connector of claim 17 further comprising a ground plate extending along an upper surface of the second insulating housing and further along an outer surface of the second insulating housing to a circuit board.

24. The card connector of claim 23 further comprising cantelever ground contacts extending through the support housing to engage the ground plate.

* * * * *